US005327974A

United States Patent [19]

Donovan et al.

[11] Patent Number: 5,327,974

[45] Date of Patent: Jul. 12, 1994

[54] METHOD AND APPARATUS FOR REMOVING DEBRIS FROM A WELLBORE

[75] Inventors: Joseph F. Donovan, Spring, Tex.; Michael J. Naquin, Youngsville, La.

[73] Assignee: Baker Hughes Incorporated, Houston, Tex.

[21] Appl. No.: 959,626

[22] Filed: Oct. 13, 1992

[51] Int. Cl.[5] ..... E21B 43/00

[52] U.S. Cl. ..... 166/311

[58] Field of Search ..... 166/297, 311, 369, 55, 166/373

[56] References Cited

U.S. PATENT DOCUMENTS

| | | | |
|---|---|---|---|
| 1,080,684 | 12/1913 | Erickson . | |
| 2,336,586 | 12/1943 | Beckman et al. . | |
| 2,371,385 | 3/1945 | Eckel . | |
| 2,371,391 | 3/1945 | Haynes . | |
| 2,500,754 | 3/1950 | Huber . | |
| 2,513,944 | 7/1950 | Kessler . | |
| 3,141,505 | 7/1964 | Tripplehorn | 166/311 |
| 4,410,051 | 10/1983 | Daniel et al. . | |
| 4,635,734 | 1/1987 | Donovan et al. . | |
| 4,681,163 | 7/1987 | Guidry et al. . | |
| 4,747,201 | 5/1988 | Donovan et al. . | |
| 4,830,120 | 5/1989 | Stout . | |
| 4,898,244 | 2/1990 | Schneider et al. . | |
| 4,986,375 | 1/1991 | Maher . | |
| 5,036,920 | 8/1991 | Cornette et al. . | |
| 5,076,355 | 12/1991 | Donovan et al. | 166/297 X |

OTHER PUBLICATIONS

"Tubing-Conveyed Perforating Systems", Baker Sand Control Manual, pp. 1-26.

"Products, Services and Accessories", Baker Sand Control Manual, pp. 1-40.

*Primary Examiner*—Thuy M. Bui

*Attorney, Agent, or Firm*—Rosenblatt & Associates

[57] ABSTRACT

The invention comprises a tool with at least one extending member which causes the fluids moving in the wellbore after perforation to increase in velocity. The velocity is further increased by an auxiliary flowpath which permits the addition of fluid from the surface or from elsewhere in the wellbore or formation to be pumped to mix with the other fluids being produced after perforation. The auxiliary fluid further increases velocity, thus improving the ability of the mixture of formation and auxiliary fluid to entrain debris and remove it from the wellbore.

21 Claims, 6 Drawing Sheets

METHOD AND APPARATUS FOR REMOVING DEBRIS FROM A WELLBORE

FIELD OF THE INVENTION

The invention relates to the field of perforating guns or other tools useful in penetrating formations in subterranean wells; specifically, in removal of debris produced from penetrating the formation. The invention is particularly useful in horizontal completions where perforating is done over an extended length in an unconsolidated formation requiring casing.

BACKGROUND OF THE INVENTION

Subsequent to drilling or workover of a subterranean oil or gas well, it is sometimes desirable to gravel pack same in order to prevent solid particulate matter in consolidated production formations from being co-produced with the fluid hydrocarbons through the production conduit to the top of the well. In such operations, a "pre-pack" well screen may be utilized, along or in conjunction with exterior conventional gravel-packing techniques. In many instances, such gravel packing is performed without use of a "pre-pack" well screen and gravel is circulated in a viscous carrier fluid for deposition around the exterior of the well screen, which is positioned across the production zone. The deposited gravel prevents the solid particulate matter within the fluid hydrocarbons to freely pass therethrough, and the screen prevents the solids forming the gravel pack from entering into the interior of the production conduit, yet permits the fluid hydrocarbons to pass through porous openings therethrough.

In some instances, the gravel packing of a subterranean well is performed by depositing solid particulate matter, i.e., sand, within a highly viscous carrier fluid. This fluid body is introduced through a tubular conduit and placed within the bore across the production zone to straddle the open perforations. Thereafter, the tubing is withdrawn from the well, and the appropriate screen assembly, which may or may not include a "pre-pack" screen, is run into the well and inserted into the viscous body of fluid containing the gravel.

Since many of the carrier fluids are a highly viscous, high molecular weight, polymeric substance, they are typically shear-thinning, thixotropic substances. Typical of such materials is a product marketed by the Kelco Corporation under the name "XC Polymer," which is a bacterial fermentation product of a polysacharide exposed to the bacteria xanthomonas campestris. When such fluid is agitated, its viscosity is reduced. However, when agitation is decreased, or stopped, the rheological property of the material is reversed and it becomes thixotropic, and the viscosity of the fluid increases substantially to permit the fluid to hold the solid particulate matter in suspension.

Due to the high viscosity and thixotropic nature of such fluids, insertion of the well "pre-pack" or other screen through the fluid will be resisted, often causing more torque and/or weight to have to be applied through the length of the drillstring. Additionally, the thixotropic properties of such fluid also contribute substantially to the difficulties in removing any such screen assemblies, thus often requiring considerably more torque to be applied through the tubing.

Such high viscous and thixotropic fluids many times are utilized as completion or "kill" fluids to be placed across the production zone prior to or subsequent to perforating the casing. In such instances, it becomes considerably more difficult to insert the gun through such viscous completion fluids or to easily withdraw same from the fluid subsequent to the perforating step.

The present sequence that is employed involves perforation of the formation using a gun mounted to the end of a tubing string below a retrievable packer. After perforating the formation and allowing the well to flow to clean up the perforations, the packer is released and the well is killed by bullheading or pumping down the tubing into the formation or by reverse circulating down the annulus and up the tubing of kill fluids of sufficient density to keep the well from coming in as the tubing, including the retrievable packer, and the perforating gun are withdrawn completely out of the well. After removing the perforating gun, the tubing is reinserted into the well to facilitate the introduction of sand as part of the gravel-packing procedure. An alternative to removing the perforating gun completely out of the well requires pulling up the perforating gun after it is fired, sufficiently above the perforations so that when sand is delivered down the tubing, the packed sand column will not reach the position of the raised-up perforating gun. In order to raise the perforating gun, the retrievable packer has to be released, which again requires an initial killing of the well by bullheading or reverse circulating as previously described. The introduction of the killing fluids to the newly perforated formation has a negative effect on the productivity of the formation through the perforations. In employing the methodology of raising the gun above the perforation or coming completely out of the hole with the gun prior to the introduction of sand, the formation is exposed to a larger volume of "kill fluids," as well as a portion of the volume in the tubing string which is displaced during the deposition of sand ("squeezing") into the perforations.

As a means of getting around pulling the gun completely out of the hole or pulling it up sufficiently high above the perforations, another alternative would be to leave the gun in place. The problem with past designs of guns has been that the placement of sand with the gun in place adjacent the perforations can result in sticking of the gun at the bottom of the hole as the sand packs around the gun.

Another concern is how well the perforations clean up after the gun is fired. With past designs, the flow velocities in the region where the gun is mounted have been sufficiently slow to prevent comprehensive elimination of debris when the formation starts to flow after the perforating gun is fired.

The placement of a structure to facilitate extraction, such as an auger blade on the gun, allows clean up by initial flowing of the well with the formation isolated. The reversing out using kill fluids, which is carried on thereafter, occurs above the packet without any effect on the newly created perforations. Thereafter, without releasing the packer or moving the gun, the appropriate charge of sand can be spotted via circulation, again with the formation isolated. When the sand is properly spotted, it can then be directed through a ported disc located between the packer and the perforating gun into the newly created perforations caused by firing of the gun. This mechanism allows the placement of sand in the formation with a specifically selected carrier fluid as opposed to commonly used killing compounds. For example, a stimulating fluid can be used to spot the sand such that when the sand is properly spotted, the amount of liquid bullheaded into the formation to place the sand in the perforations can be a limited quantity of the most beneficial fluid to promote efficient flow of hydrocarbons from the formation through the newly made perforations created by shooting off the gun.

The auger blade around the perforating gun, which straddles the openings in the perforating gun so as not to be damaged by shooting off the gun, creates several advantages. After the formation is perforated and begins to flow, the flights of the auger create a tortuous path, thereby increasing the velocity of the gases and/or liquids produced from the formation. This increased velocity promotes the removal of the debris generated from firing the gun. Additionally, the positioning of the auger blades on the outside of the perforating gun facilitates the removal of the gun, even after the sand is pumped into the perforations. The string can be merely lifted and/or simultaneously rotated and the addition of the flights allows the gun to avoid getting stuck in the compacted sand at the newly packed perforations. in essence, the only resistive force against removing the gun from the sand is the weight of the sand accumulated between the flights of the auger. To the extent necessary, a rotational force can be applied to the gun to facilitate its removal in case of sticking. In the preferred embodiment, the auger is disposed in a manner such that rotation of the drillstring to tighten up its components results in a counter-rotation of the flights of the auger to assist in breaking loose from any obstruction as the gun is removed from the sand. The auger can be left- or right-handed without departing from the spirit of the invention.

With the advent of directional drilling, formations are now perforated in ever increasing lengths. Rather than having a perforating gun extending for about 20–50 feet, assemblies of perforating guns for deviated wellbores are now in use where the perforation takes place over a much longer length of wellbore. Lengths of 3,000–4,000 feet are not unusual. In many cases, the formation which being perforated is unconsolidated. This requires the wellbore to be cased prior to perforation to avoid collapse of the wellbore upon perforation. This has additionally created the need for a better way to remove perforation debris because wells with longer lengths of perforated formation produce a greater volume of debris than typical vertical wells. It has also enhanced the concerns about removal of the perforating gun in view of the extremely long lengths of gun placed in the wellbore.

In the past, where gun lengths have been short, it has been satisfactory to circulate fluids or reverse circulate fluids using the tubing in the annulus to remove debris. However, the low point of the circulation flowpath is above the top of the gun. Accordingly, the debris generated in the immediate proximity of the perforating gun is not effectively removed by circulation or reverse circulation.

Additional problems are created by small depth deviated wellbores where the zone to be perforated is nearly horizontal and extends for a significant length. Using existing available perforating equipment, kill fluids cannot be brought close to the newly formed perforations because of the location of the low point in the circulation or reverse circulation flowpath. The inability to get heavy weight brines or other kill fluids into the immediate viciniy of a perforation which extends several thousand feet, albeit at a low depth from the surface, can present a significant problem. The possibility exists that the well may actually come in during the efforts to circulate out the debris. This can occur because an insufficient weight of heavy fluid bears down on the newly made perforations in shallow deviated wells.

The apparatus of the present invention has been developed to assist in dealing with some of these problems. To facilitate the removal of debris after perforation, the perforating gun or another tool run in subsequent to the perforating of the wellbore can have a tortuous path formed on its outer periphery, or any other mechanism or projection which will increase the flowing velocity. An auxiliary source of fluid can be applied from the surface or from within the wellbore, internally through the tool or perforating gun or adjacent its exterior periphery, or if the tortuous path is formed from a hollow-flight auger, the auxiliary fluid can be added from the surface or from within the wellbore through the auger flights, and extending to a predetermined depth of the auger. While the energy of the formation fluids when the well is allowed to flow is used in combination with the tortuous path to pick up the debris generated in perforation, the use of the auxiliary fluid further increases velocity and the ability to efficiently remove the generated debris.

Augers have previously been applied to screens, as illustrated in U.S. Pat. Nos. 2,513,944; 1,080,684; and 2,371,391. Also cited as relevant to the general field of tubing-conveyed perforating and sand control are U.S. Pat. Nos. 4,681,163; 2,336,586; and manuals put out by Baker Sand Control, a Baker Hughes company, regarding perforating systems, entitled "Tubing-Conveyed Perforating Systems," as well as a manual on gravel-packed systems put out by Baker Sand Control entitled "Products, Services and Accessories."

SUMMARY OF THE INVENTION

The invention comprises a tool with at least one extending member which causes the fluids moving in the wellbore after perforation to increase in velocity. The velocity is further increased by an auxiliary flowpath which permits the addition of fluid from the surface or from elsewhere in the wellbore or formation to be pumped to mix with the other fluids being produced after perforation. The auxiliary fluid further increases velocity, thus improving the ability of the mixture of formation and auxiliary fluid to entrain debris and remove it from the wellbore.

BRIEF DESCRIPTION OF THE DRAWINGS

FIG. 7 is a section through line 7—7 of FIG. 6, showing an alternative embodiment involving a hollow member for use in increasing the velocity of formation fluids when the well is brought in.

DETAILED DESCRIPTION OF THE PREFERRED EMBODIMENT

Figure 1:
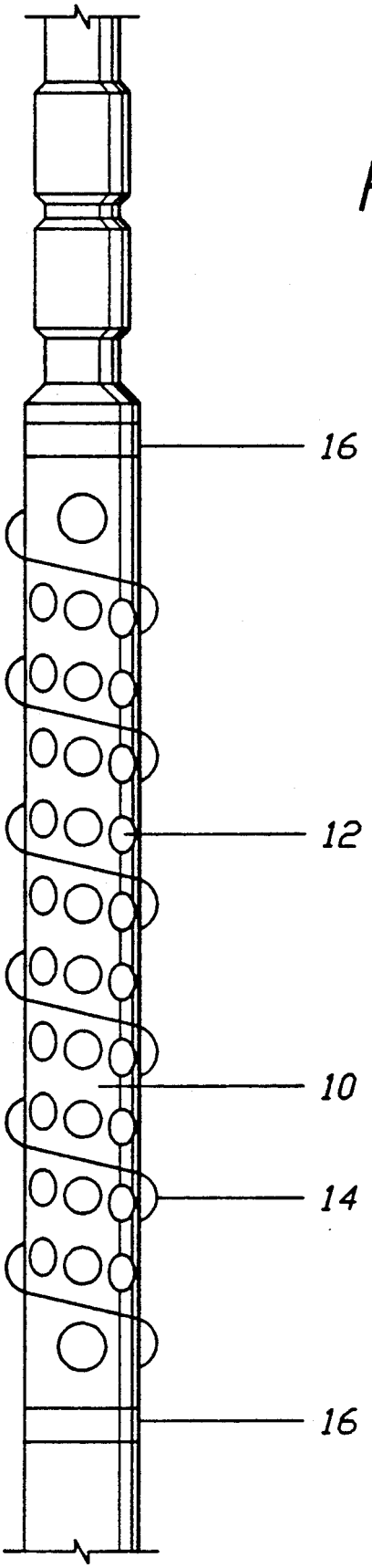
FIG. 1 is a schematic representation of the perforating gun, showing the auger on the outside of the perforating gun.

The apparatus is shown in FIG. 1. The perforating gun is generally referred to as 10. Perforating gun 10 can be of various lengths and is generally assembled in sections to the desired length. Extending substantially through perforating gun 10 along its longitudinal axis is a flowpath 62. On the outer surface of perforating gun 10 are a plurality of ports 12 through which the explosive charge exits and perforates the formation. As seen in FIG. 1, the ports 12 are generally arranged in a helical pattern around the periphery of perforating gun 10, and a structure 14 is shown on the outer periphery of perforating gun 10. In one preferred embodiment, the structure 14 is an auger. While the structure 14 is schematically represented as being continuous, it may have periodic discontinuities if perforating gun 10 is assembled from a plurality of joints to obtain the desired length. There may be a slight gap which is preferably less than 12 inches. The pitch is preferably 4–8 inches.

Figure 5:
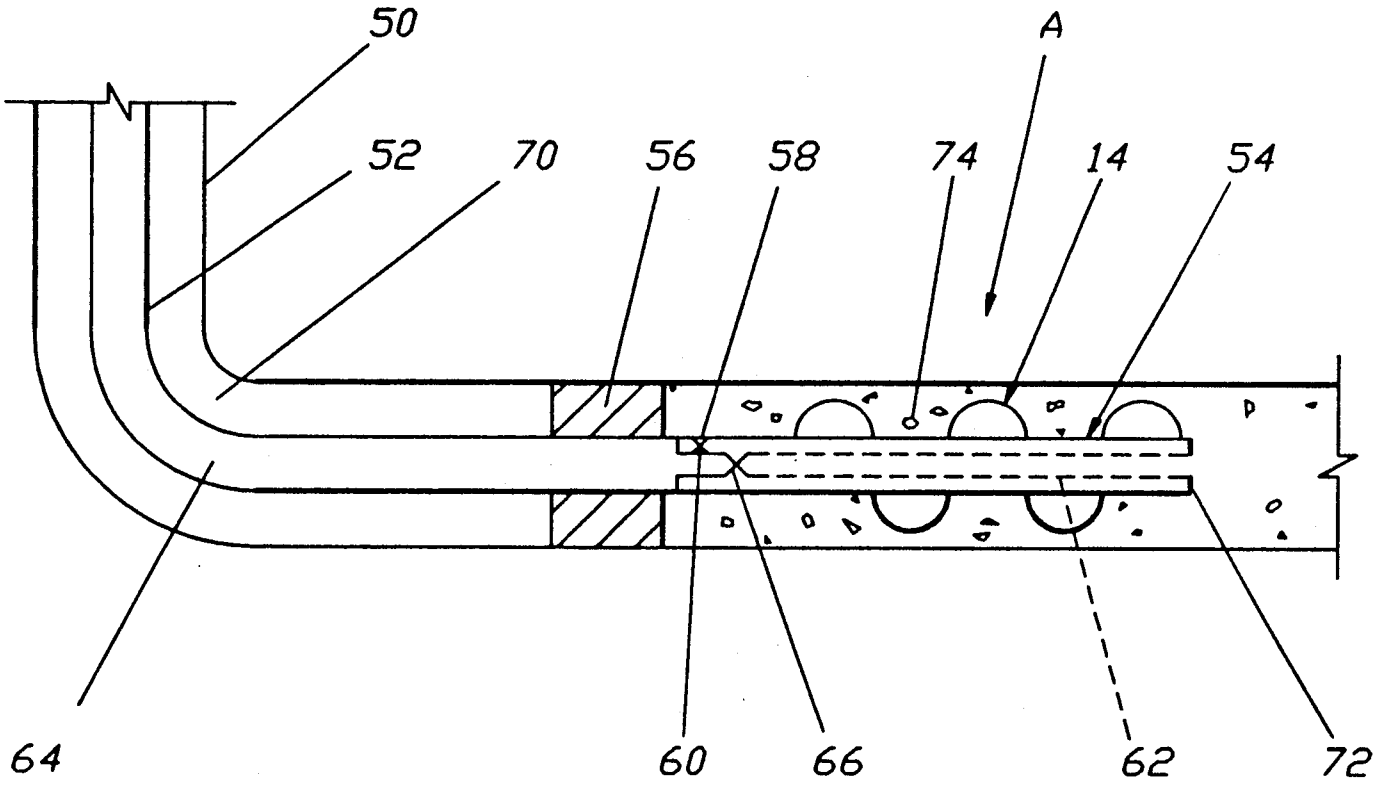
FIG. 5 is a detailed view of the perforating gun shown in FIG. 1.

The apparatus of the present invention is shown in detail in schematic form in FIG. 5. There, a deviated wellbore 50 is illustrated as an example of the use of the invention. A tubing string 52 is used to place the perforating gun 54 in the desired position in the wellbore 50. A wireline device can also be used for facilitating such insertion. The length of the gun 54 can be several thousand feet or more. Those skilled in the art will appreciate that the gun is assembled in components at the surface, and then lowered into position using tubing string 52. A packer 56 can be attached to the tubing string 52 adjacent gun 54. Mounted adjacent the packer 56 and prior to attachment of gun 54 is a subassembly which normally contains a flowport 58. A valve 60 is shown schematically in the flow-path between tubing string 52 and port 58. Those skilled in the art will appreciate that valve 60 can be designed in a number of different ways so that it can be selectively operated from the surface into an open and closed position to facilitate circulation or reverse circulation as needed.

The perforating gun 54 of the present invention also has an internal longitudinal flowpath 62. Flowpath 62 extends the length of the gun 54 and is in fluid communication with internal passage 64, which extends through tubing string 52. Another valve 66 can be optionally placed in flowpath 62 at any point during its length for selective operation from the surface into an open or closed position to facilitate circulation or reverse circulation as needed. Valve 66, just like valve 60, may be configured in a number of different ways as those skilled in the art will appreciate. Alternatively, flowpath 62 can be provided without valve 66. Mounted to the exterior of gun 54 is a structure 14 which, in the preferred embodiment, takes the shape an auger.

In operation, the gun 54 is assembled in components at the surface and is placed in position in the wellbore 50 by a suitable rig (not shown). Thereafter, additional section of tubing string 52 are added until the gun 54 is at the required location in the wellbore 50. While FIG. 5 illustrates a deviated wellbore, the operational principles of the apparatus are equally applicable in vertical wellbores and wellbores that are less deviated than that shown in FIG. 5. Having placed the gun 54 in position, the packer 56 can be set to isolate the annulus 70 prior to shooting the gun.

While the schematic representation of FIG. 1 shows the structure 14 connected directly to the outer surface of the perforating gun 10, it is also within the purview of the invention to take the structure 14, which has a general helical pattern, and mount it to a mandrel or hollow core which can slip over the outer periphery of perforating gun 10 and be fitted up so that the openings 12 not only align with openings on the core but also fall between the flights to avoid damage to the structure 14 when the gun 10 is fired. In the latter configuration, the structure 14, mounted on a core which is basically a tube that overlays the perforating gun 10, is connected to perforating gun 10 by fasteners which extend through the mandrel into receptacles 16 mounted to perforating gun 10. The structure 14 should be noted as being left-hand. The normal direction of rotation of the rotary table is right-hand, which results in the tightening up of all the joints in the tubing string above perforating gun 10. The advantage of making structure 14 with a left-hand thread is that it facilitates removal of the gun 10 from the compacted sand in the event any obstruction is encountered. The turning of the rotary table, which in turn acts to tighten all the joints, drives the structure 14 in the opposite direction to promote loosening of the gun 10, which may stick in the compacted sand.

The structure 14 extends beyond the perforations. In the preferred embodiment, the length of the auger above the perforation should be approximately equal to the length of the auger in the perforated zone.

Figure 2:
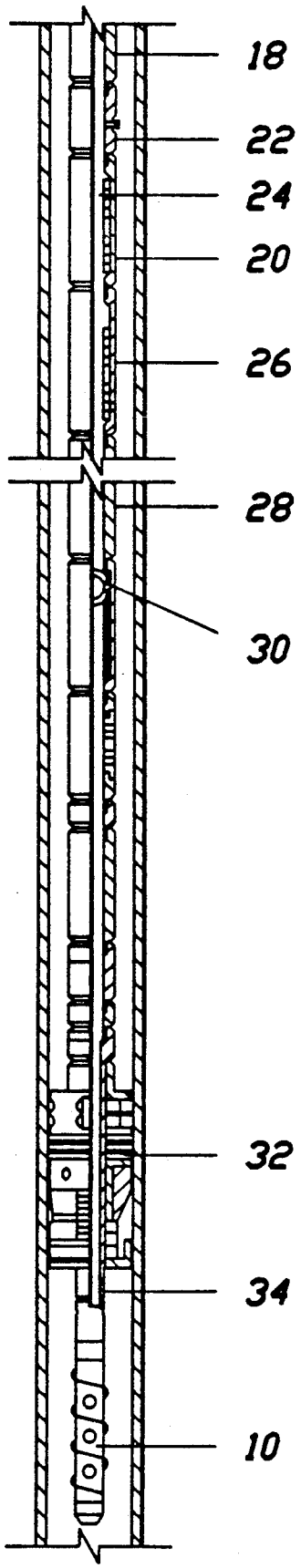
FIG. 2 is a schematic representation of a typical assembly using the apparatus of the present invention while running into the well prior to perforating.
Figure 3:
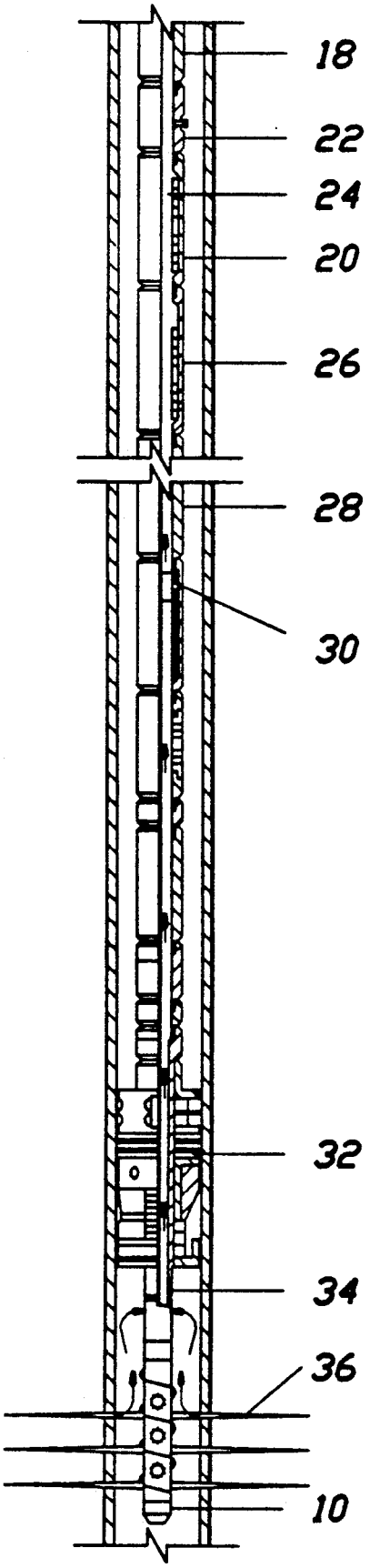
FIG. 3 shows the assembly in FIG. 2 and the flows that ensue immediately after perforation.

Some of the advantages of using the structure 14 can be further appreciated by examination of FIGS. 2 and 3, which show a preferred embodiment of the tubing string above the gun 10. Drill collars 18 are located toward the bottom of the tubing string. Below the drill collars is an annular operated reversing valve (AORV) 20 which is responsive to the pressure in the annulus 22 to allow flow from the annulus 22 into the tubing 24. Below the AORV 20 is a multi reverse circulating valve (MRCV) 26. Below the MRCV 26 are additional drill collars 28, followed by a pressure-operated test valve (POTV) 30. Below the POTV 30 are a recorder carrier, hydraulic jars, a rotational release safety joint, a crossover sub, and a retrievable packer 32. Below the packer is a ported disc assembly 34, which is followed by the mechanical firing head, then the perforating gun 10.

Figure 4:
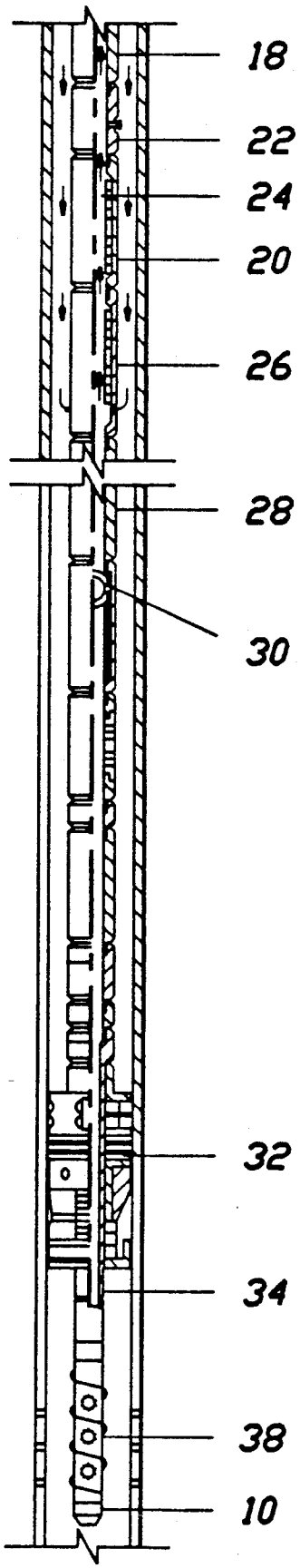
FIG. 4 is the view of FIG. 2 during killing the well by reversing out.

FIG. 2 shows the position of the components while running in the hole. The seals on the packer 32 are retracted. The POTV 30 is closed, as are the MRCV 26 and the AORV 20. Thereafter, an underbalance may be created using nitrogen followed by setting the packer 32 to seal off the annulus 22 from the formation to be perforated. The perforating gun 10 is fired. As shown in FIG. 3, upon firing of the gun 10 the formation begins to flow through the perforations 36 and/or the openings 38 if it is a cased hole (see FIG. 4). The formation begins to flow, bringing with it the debris generated by the functioning of gun 10. The flow is directed toward the ported disc 34, which is in fluid communication with the inside of the tubing 24. The flow up toward ported disc assembly 34 proceeds along the helix of auger 14, as shown by arrows 40 in FIG. 1. Thus, one of the advantages of structure 14 is illustrated in that the relatively narrow spiral path followed by the fluids produced from the formation increases their velocity and improves the ability of those fluids to carry with them the debris generated by the actuation of the gun 10. After the perforating and after allowing a sufficient time for the well to flow to remove debris to the surface, the perforations 36 can be isolated by using POTV 30 and putting it in a closed position. Thereafter, reverse circulating with kill fluid can proceed, as shown in FIG. 4, through the MRCV 26 to remove any debris and produced hydrocarbons from the tubing 24 as well as killing the well by flowing down through the annulus 22, through the MRCV 26 and up the tubing 24. Thereafter, sand can be spotted adjacent POTV 30 by pumping down the tubing 24 with a suitable carrier fluid, preferably a stimulating fluid, with the POTV 30 closed and the AORV 20 or the MRCV 26 open. In this manner, the sand can be spotted adjacent POTV 30 without introduction of any well-killing fluids into the formation. It should be appreciated that up until this time there has been no surface-applied pressure against the formation from the reversing out, nor have any of the chemicals normally associated with killing the well by the method of circulating or reversing out come in contact with perforations 36. When the charge of sand is located adjacent POTV 30, it is then opened, with AORV 20 and MRCV 26 closed. The carrier fluid for the sand is thus forced into the formation by being pushed through ported disc assembly 34 into perforations 36. The sand is deposited in perforations 36. The amount of sand to be pumped is determined from the amount of debris recovered, the volume of the well in the area surrounding the perforations, and an additional charge of approximately 25 percent to replace the volume taken up by the gun 10 after its removal. The stimulating fluid carrying the sand is pumped until an increase in pressure is observed at the surface, indicating that the sand has been sufficiently packed into the perforations 36, a situation commonly referred to as a "screen out." It should be noted that throughout this procedure, the packer 32 remains seated, sealing off the perforations 36 from the annulus 22.

Having appropriately placed the sand into the perforations 36, the gun 10 is withdrawn by applying an upward force to the tubing 24 after releasing the packer 32. The presence of the structure 14 facilitates the extraction of the gun 10. Instead of prior designs where the sand could compact around and on top of the gun 10, leaving a large surface area on gun 10 to adhere to the packed sand, the presence of the structure 14 creates numerous parallel shear lines around its outer periphery which can easily overcome the forces applied by the compacted sand to facilitate release of the gun 10 upon upward pulling of the tubing string 24. The pulling force on tubing string 24 must initially be high enough to overcome the weight of all the sand wedged between the flights of structure 14 and an additional incremental force to initiate the shearing action in the sand layer, thus initiating upward movement of the gun 10. It should be noted that rotation of the gun 10 is not necessary in a normal circumstance as the gun 10 should easily come out in view of the structure 14. However, the tubing string 24 can be rotated while it is being lifted to initiate rotation of gun 10 along with the lifting force. Due to the left-hand thread of structure 14, the right-hand rotation of gun 10 imparts a loosening force or an unscrewing motion to the gun 10 to facilitate its upward movement in the well for ultimate removal at the surface. In an extreme case, the fasteners holding the core and structure 14 can be sheared off, allowing the core to drop off while the gun 10 is retrieved.

Having removed the gun 10 from the hole, a screen can be mounted to the bottom of the tubing string 24, which itself has an auger similar to that of structure 14. This screen is lowered into the compacted sand at the perforations 36 and, to the extent necessary, rotated into the compacted sand or simply lowered into the compacted sand by its own weight and the weight of the tubing string above it without any rotational force, depending upon the application. Of course, in these situations the packer 32 is once again connected to the tubing string directly above the gravel-pack screen, which is placed in the sand adjacent the perforations 36. Thereafter, normal production from the perforations 36 can begin through the screen.

In the preferred embodiment, the spacing of the flights on structure 14 is preferably approximately 4–8 inches.

One of the advantages of having structure 14 on a core, which can be fastened to the gun 10 through fasteners engaging the gun 10 at opening 16, is that in the event a serious problem of sticking the gun 10 does arise, the tubing string 24 can be rotated to shear off the fasteners engaging the gun 10 at opening 16, facilitating removal of the gun 10 while leaving the structure 14 mounted to the core, in the hole for subsequent removal by a fishing operation. Alternatively, the core can be welded to the gun 10 without departing from the spirit of the invention.

The structure 14 continues above the openings 12 so that when the extra charge of sand is pumped down the tubing 24 and adjacent the perforations 36, the entire gun 10 that may be embedded in sand has the auger continuing on its outer face beyond perforations 36 so that the structure 14 facilitates the removal operation.

Another advantage of structure 14 is it acts as a centralizer for the gun 10.

The structure 14 mounted on a core can be taken off one gun 10 and reused on another gun which has a similar pattern of openings 12. As to the gravel-pack screen which is inserted after the gun 10 is removed, the auger blades that would be on it have a right-hand thread to facilitate the screwing in forces which can be imparted to the tubing 24 to get the screen to go into the packed sand.

Although the above described procedure is adequate for removing debris in standard wells, the apparatus of the present invention, as shown in FIG. 5, makes use of flowpath 62. Considering that the length of gun in the wellbore 50 can be as long as 2,000 or 3,000 feet or more, there is a significant amount of debris that accumulates between the wellbore 50 and gun 54 subsequent to perforation of the formation. It can readily be seen that circulation through valve 60 and port 58 will not effectively remove debris that is located between the gun 54 and the wellbore 50 at a point removed from port 58 by several thousand feet or more. Accordingly, in order to assist in the removal of accumulating debris, circulation can be started through internal passage 64 from the surface, down through valves 66 and through flowpath 62, and out of gun 54 through opening 72. In the circulation mode, the flow would exit opening 72 and carry the debris 74 upwardly through relaxed packer 56 and out through the annulus 70. In the reverse circulating mode, the flow would be in the opposite direction from that just described. Using the energy of the fluid, either circulating or reverse circulating, the debris 74, in combination with a spiral path created by the structure 14 in the form of an auger, further assists in increasing the velocity in the zone adjacent the gun 54. The increase in fluid velocity by virtue of the spiral path created by the auger 14 assists in suspension of the debris 74 for removal from the wellbore 50.

Additionally, the presence of the flowpath 62 facilitates placement of brines or other heavy kill fluids in the region of the perforations made by gun 54.

The well operator has greater control of the well by having the ability to place kill fluids in the region of opening 72 after bringing in the well. The kill fluids can now be spotted by circulation rather than in the inefficient method of bullheading, which inherently involves disturbance of the formation.

The problems of the gun 54 sticking are more exaggerated when the gun lengths involve several thousand feet or more. Accordingly, the structure 14 becomes even more significant the longer the gun lengths involved.

Figure 6:
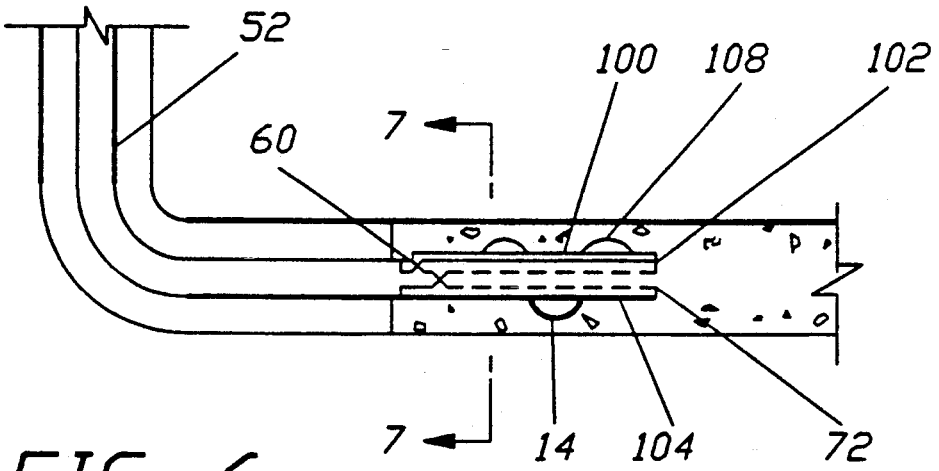
FIG. 6 is an alternative embodiment of the apparatus of the present invention shown in FIG. 5.
Figure 7:
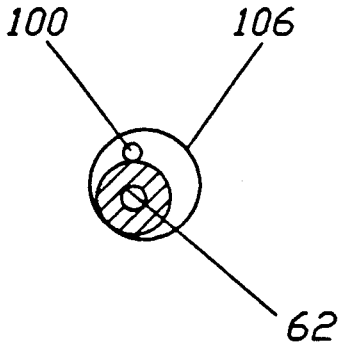

It should be noted that the scope of the invention is broad enough to include several additional alternatives which will now be described. While the prior reference to the invention has indicated that a tortuous path can be created by a helical member 14, various other shapes can be used to extend from the gun 54 in order to create a tortuous flowpath for the debris 74. In fact, the tortuous flowpath resulting from an externally extending member 14 does not necessarily have to be mounted to a gun 54. What is illustrated in FIG. 5 and described as a gun can, in fact, be nothing more than an elongated housing which, on its outer periphery, includes extending member or members which, in fact, create a tortuous path when the formation fluids are allowed to flow into the wellbore. When so constructed, the well is perforated with a perforating gun 54, which is removed before allowing the well to come in. In a second trip into the wellbore, the elongated housing, having a similar external appearance to gun 54, along with the extending member or members to create the tortuous path, are inserted into the wellbore adjacent the newly perforated formation. The well is then allowed to flow. While the extending member or members 14 provide a tortuous path which increases the velocity of the formation fluids as they enter the wellbore from the formation, thereby entraining the debris 74, auxiliary fluids can be fed from the surface through flowpath 62 and out of opening 72. Flowpath 62 can terminate before lower end 102 without departing from the spirit of the invention. The addition of external fluid through opening 72 further increases the velocity and improves the efficiency of the debris removal. Alternatively, as shown in FIGS. 6 and 7, the auxiliary fluid passage 100 can extend on the outside of the housing to a predesired depth. While shown to extend the full length in FIG. 6, it is within the scope of the invention to cut off path 100 at a point short of the bottom. The flowpath 100 can be an auxiliary tube that extends from the surface to the lower end 102. Alternatively, the flowpath 100 can be connected to valve 60 and extend on the exterior of the housing 104. The flowpath 100 is supplied from the surface through tubing 52. As a further alternative, the tortuous path can be created by a hollow flight helix 106 (see FIG. 7). In such an embodiment, the flowpath 100 is in fluid communication with the internals of the hollow flight helix 106, and an opening 108, such as shown illustratively in FIG. 6, can be employed at the preselected point in the helix 14, to allow the auxiliary fluid put in from the surface or different points in the wellbore to be pumped in conjunction with the bringing in of the well to further increase the velocity of the formation fluids and improve the ability of such fluids to entrain debris. Opening 108 can be at any point along the helix 14 without departing from the spirit of the invention.

Figure 8:
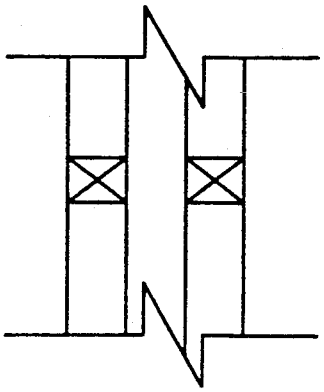
FIG. 8 is another alternative embodiment showing a flexible member inserted through a packer.
Figure 9:
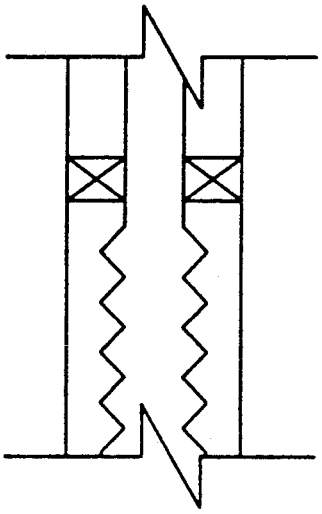
FIG. 9 shows the alternative embodiment of FIG. 8, involving a force applied to the compressive member causing it to deflect and create a tortuous path.

Those skilled in the art can appreciate that rather than adding auxiliary fluids through flowpath 100, opening 72, or opening 108, the process can be reversed so that the formation fluid with the debris is forced to exit the wellbore through openings 108 or 72, or flowpath 100. Rather than applying pressure as previously described, a vacuum can be applied to openings 72 or 108 or flowpath 100 to assist in the removal of the formation fluids entraining the debris. Accordingly, the extending member or helix 14 that create the tortuous path can accommodate a flow in either direction, depending upon the removal point of the produced fluids and entrained debris. The extending members 14 can be a plurality of bars or shapes which create a tortuous path in between them. Alternatively, a flexible shape 110 can be inserted in the low-profile position shown in FIG. 8. By applying a force to the flexible shape 110, deflection is created which in turn can act to provide the tortuous path for the fluids produced from the wellbore. This can be accomplished by a variety of devices including a compressive force which results in the deformation shown in FIG. 9 and the creation of the tortuous path.

Accordingly, there has been shown an improvement in the ability of well operators to obtain efficient cleaning of the formation using a tool which could be a perforating gun or could be nothing more than an elongated housing, having a tortuous path on its periphery. The debris removal is facilitated by the use of auxiliary fluids, either under pressure or by applying a vacuum to increase the velocity of the formation fluids flowing into the wellbore along the tortuous path so as to better entrain the debris and remove it from the wellbore.

The foregoing disclosure and description of the invention are illustrative and explanatory thereof, and various changes in the size, shape and materials, as well as in the details of the illustrated construction, may be made without departing from the spirit of the invention.

We claim:

1. A tool for removing, at least in part, debris from a wellbore, comprising:

an elongated body;

means on said body for increasing velocity of fluids flowing into the wellbore by providing a restrictive flowpath which causes the increased velocity of the fluid to carry off debris away from said body; and auxiliary fluid feed means for introducing an auxiliary fluid adjacent said means for increasing velocity, to further increase velocity of the flowing fluid through said means for increasing velocity, as an assist to carrying off debris away from said body and out of the wellbore.

2. The apparatus of claim 1, wherein said auxiliary fluid feed means further comprises:

a flowpath internal to said body.

3. The apparatus of claim 2, wherein said flowpath extends the substantial length of said body.

4. The apparatus of claim 1, wherein said auxiliary fluid feed means further comprises:

a flowpath external to said body.

5. The apparatus of claim 4, wherein said flowpath extends the substantial length of said body.

6. The apparatus of claim 1, wherein said means for increasing velocity further comprises:

at least one extending member from said body, said extending member creating a tortuous path to increase fluid velocity.

7. The apparatus of claim 6, wherein said extending member is hollow and forms an internal flow channel.

8. The apparatus of claim 7, wherein:

said hollow member comprises a helix;

said auxiliary fluid feed means further comprises:

an inlet to said internal flow channel to allow introduction of auxiliary fluid, and an outlet to allow auxiliary fluid to exit from said internal flow channel and enter said tortuous path, thereby increasing the velocity in said path.

9. The apparatus of claim 2, wherein said means for increasing velocity comprises a helix.

10. The apparatus of claim 4, wherein said means for increasing velocity comprises a helix.

11. The apparatus of claim 1, wherein:

said means for increasing velocity is integrally formed as a part of said body;

said body is made of a flexible material;

said body having a first profile when lowered in place in a wellbore and a second larger profile defining the means for increasing velocity after movement of the flexible material.

12. The apparatus of claim 1, wherein said body further incorporates a perforating gun.

13. The apparatus of claim 2, wherein said body further incorporates a perforating gun.

14. The apparatus of claim 4, wherein said body further incorporates a perforating gun.

15. The apparatus of claim 6, wherein said body further incorporates a perforating gun.

16. The apparatus of claim 12, wherein said means for increasing velocity further comprises:

means extending from the outer periphery of said gun, in a generally radial direction from its longitudinal axis, for facilitating extraction of said gun from the well, said means operable when said gun is covered at least in part with a solid material delivered into the well and lodged between the formation and said gun, wherein said means for facilitating extraction creates at least one shear plane at its periphery to reduce the extractive force required to remove said gun.

17. The apparatus of claim 1, further comprising:

a tubing string connected to said body;

a packer mounted to the tubing.

18. A method of removing debris from a wellbore, comprising the steps of:

placing an elongated body having an extending member on its periphery in the wellbore;

allowing formation fluid to flow into the wellbore;

increasing the velocity of the fluid as it passes adjacent said member;

adding an auxiliary fluid adjacent said body;

further increasing the velocity of the mixture of the formation and auxiliary fluids as the mixture passes said extending member;

entraining debris in the moving fluids;

removing the debris from the wellbore.

19. The method of claim 18, further comprising:

mounting a perforating gun to the elongated body.

20. The method of claim 19, further comprising:

creating a tortuous path with said extending member.

21. The method of claim 20, further comprising:

creating a helical tortuous path with said extending member.

* * * * *